United States Patent [19]

Richter

[11] 3,963,998

[45] June 15, 1976

[54] VARIABLE BANDWIDTH TUNABLE DIRECTIONAL FILTER

[75] Inventor: Edwin William Richter, Acton, Mass.

[73] Assignee: RCA Corporation, New York, N.Y.

[22] Filed: Mar. 13, 1975

[21] Appl. No.: 558,002

[52] U.S. Cl. ..... 333/73 W; 333/10

[51] Int. Cl.[2] ..... H01P 1/20

[58] Field of Search ..... 333/10, 73 R, 73 W, 333/83 R

[56] References Cited

UNITED STATES PATENTS

| | | | |
|---|---|---|---|
| 2,697,209 | 12/1954 | Sichak et al. | 333/83 R X |
| 3,042,883 | 7/1962 | Pamenborg et al. | 333/73 W X |

*Primary Examiner*—Paul L. Gensler
*Attorney, Agent, or Firm*—Edward J. Norton; Joseph D. Lazar; Robert M. Rodrick

[57] ABSTRACT

A variable bandwidth tunable directional filter to directionally route a broadband signal between an input and an output microwave transmission line for controlling and processing signals in data handling systems. The transmission lines are waveguides directionally coupled to a ring resonator having frequency response characteristics at resonance of a band-pass filter. The ring resonator directionally coupled to transmission lines is capable of resonating with waves progressing unidirectionally. Tuning to resonance is achieved by adjusting the guided wave in the ring by the insertion into the ring of flat dielectric material which also provides for a broadband impedance match of the coupled circuits. Broadening of the filter bandwidth is achieved by additional attenuation in the ring resonator which also decreases the insertion loss due to the coupling of the resonator to the waveguides. Reduced insertion loss provides for a retention of a portion of the signal in the input line which allows for additional coupling of other lines within the same frequency bandwidth.

8 Claims, 4 Drawing Figures

VARIABLE BANDWIDTH TUNABLE DIRECTIONAL FILTER

The invention herein described was made in the course of or under a contract or subcontract thereunder with the Department of the Air Force.

BACKGROUND OF THE INVENTION

1. Field of the Invention

This invention relates to a directional filter used in data handling systems and, more particularly, to a variable bandwidth microwave directional filter which is dielectrically tuned to resonant frequency and additionally attenuated for broadened bandpass filter bandwidth and reduction of coupling insertion loss.

2. Description of the Prior Art

In data handling systems requiring the implementation of microwave technology for broad bandwidth, high frequencies, and system configuration needs, data buses are used to serve the systems and to control data transfer. Buses can be utilized for unidirectional or bi-directional transmission and can be adapted to the frequency bandwidths requirements of the system.

Coupling of the data bus to transmission lines to perform the required functions can be accomplished by a directional coupler with a series bandpass filter. Conventional microwave cavities are used as filtering elements where nondirectional coupling is applied and standing waves are involved. When directional coupling is applied, waves progressing in one direction are obtained. Directional filtering of traveling waves is achieved by coupling a ring-shaped transmission line to the two transmission lines. The ring is closed and is any integral number of wavelengths in circumference. One approach of this type directional filter emphasizes a limited strip line or microstrip application as discussed in two papers, one by Cohn, S. B. and Coale, F. S., "Directional Channel-Separation Filters," Nat. Conv. Record IRE, 1956, Part 5, p. 106 and Proc. IRE 1956, 44, p. 108, and the other by Coale, F. S., "A Travelling-Wave Directional Filter," Trans. IRE, 1956, MTT-4, p. 256.

The properties of microwave circuits utilizing a waveguide coupled to a single transmission line is discussed by F. J. Tischer in his paper "Resonance Properties of Ring Circuits," Trans. IRE, MTT-5, 1957, p. 51. The coupling of the ring circuit to the transmission line is through two quarter wave spaced apertures in the waveguide. The wavelengths at which resonances occur in such a ring guide is expressed by $$\lambda_{res} = \left[ \frac{1}{\frac{N^2}{L^2} + \frac{1}{4A^2}} \right]^{1/2} \qquad (1)$$

where: $N$ is the integral number of wavelengths in the ring, $L$ is the mean circumference of the ring, and $A$ is the width of the guide in the ring where the ring guide is a rectangular waveguide. Adjustment of the guide width, $A$, by screwing one half of the guide in or out relative to the other results in a variation of the wavelength in the guide and of the resonant wavelength and is thereby a means of tuning the ring circuit. Problems arise with mounting ring circuits of this type since the adjustment results in a movement in the relative positions of the waveguide connection flanges. The bandwidth of such a resonating device is a function of the quality factor, Q, of the ring resonator. A decrease in Q results in increased resonator bandwidth and an increase in Q results in decreased bandwidth. Q is dependant upon such factors as the characteristics of the ring transmission line, the number of wavelengths in the ring and any additional attenuation introduced in the ring. For example, a decrease in the height of the ring reduces Q just as an addition of attenuation decreases Q. The lowest value of Q achieved by Tischer is of the order of 2700 which would seem to indicate a small chance of large instantaneous bandwidth, which would tend to limit the application of the device for data buses.

Subsequent designs extend Tischer's concept by adding an output guide to achieve a directional filter status of the device. U-shaped input and output guides coupled to a ring structure are used whereby tuning is achieved by mechanically adjusting the width of the ring guide. This mechanical adjustment creates the same problem as Tischer's device in that the relative positions of the waveguide connection flanges are varied resulting in mounting difficulties.

Further development of the ring filter concept is discussed in a paper by Ohtomo, I., and Shimada, S., "A Channel-Dropping Filter Using Ring Resonator for Millimeter-Wave Communication System," Elect. Comm. Japan, Vol. 52—B, No. 5, 1969, p. 57. U-shaped input and output guides are used which are coupled to a single or double ring resonator. Coupling of the rings to the guides is achieved through the side walls of the ring as well as the top walls. Where the coupling is through the top wall the variation of the guide width to tune the resonator cannot be used. In its place, a dielectric rod is gradually introduced to tune the ring resonator. A problem which arises with the device described by Ohtomo is that the broadband match of the coupled circuits depends upon the amount of the insertion of the dielectric rod into the ring cavity. The dielectric rod, if not tapered or gradual, results in a mismatch of the impedances between the ring resonator and transmission lines. Another problem arising in the utilization of this device in data bus systems is the more difficult mounting of the U-shaped guides. Space and economical factors are considered in the design of data buses for microwave systems applications and the U-shaped waveguide structure is a less suitable mounting arrangement.

Most, if not all, directional filters of the prior art have commonality in that they couple all of the signal at the resonant frequency of the ring from the input to the output line. Insertion loss due to tight coupling with little or no ring attenuation is excessive in the frequency band of the directional filter. Since the insertion loss is high, none of the signal is retained in the input line when coupled to the output line, all of the signal being transferred. Therefore, other couplers in series would be starved for signal thereby not permitting any additional coupling of other lines within this frequency bandwidth. Furthermore, in certain prior art arrangements, the means for varying the filter bandwidth by changing the attenuation or the quality factor, Q, is directly related to the tuning means thereby minimizing the degrees of freedom for attaining optimum results.

SUMMARY OF THE INVENTION

The present invention is directed to a variable bandwidth tunable directional filter to directionally route a substantially broadband signal between an input and an output microwave transmission line in data handling systems. The transmission lines are waveguides directionally coupled to a ring resonator within which an electromagnetic wave is propagated. The circumference of the ring resonator is any integral number of wavelengths of the guided wave. The resonant frequency of the ring resonator is tunable by adjusting the length of the guided wave in the ring by introducing a dielectric material into the ring resonator. The ring resonator directionally coupled to the waveguides is capable of resonating with waves progressing in one direction. The frequency response of the ring resonator at resonance is characteristic of a band-pass filter. Additional attenuation in the ring broadens the bandwidth of the filter and also reduces the insertion loss in the input line due to coupling of the resonator to the waveguide. Decreased insertion loss results in a retention of a portion of the signal in the input line allowing for additional coupling of other lines within the same frequency bandwidth.

DETAILED DESCRIPTION OF THE PREFERRED EMBODIMENT

Figure 1:
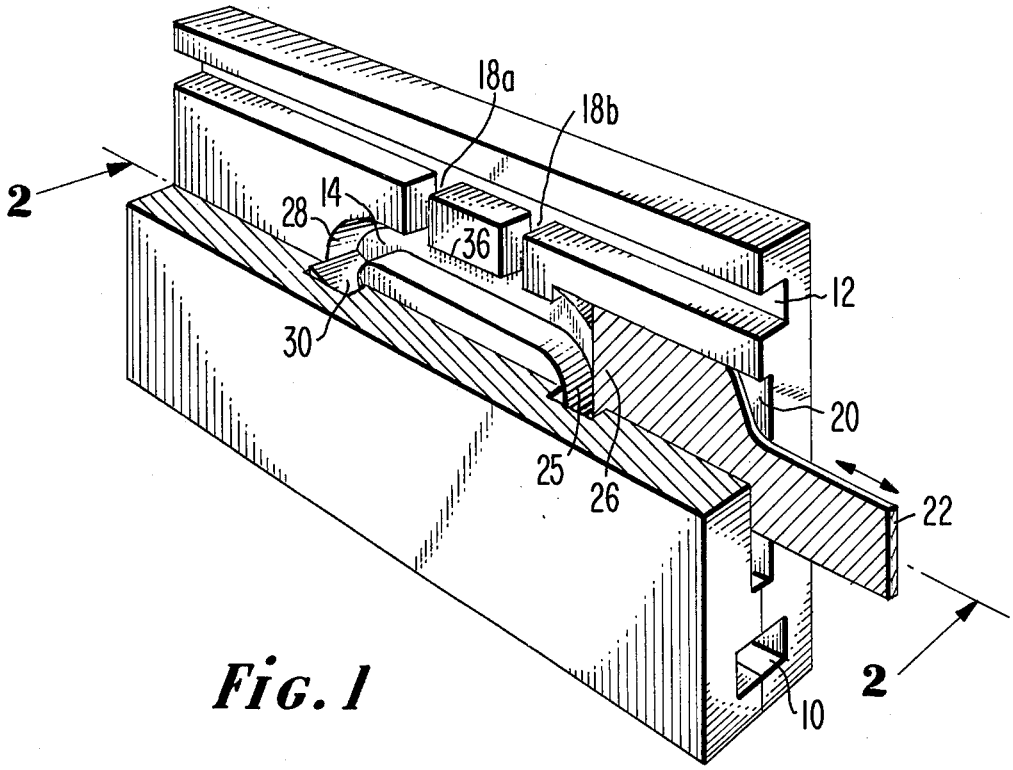
FIG. 1 is a partially sectioned perspective view of a microwave apparatus containing a preferred embodiment of the invention.
Figure 2:
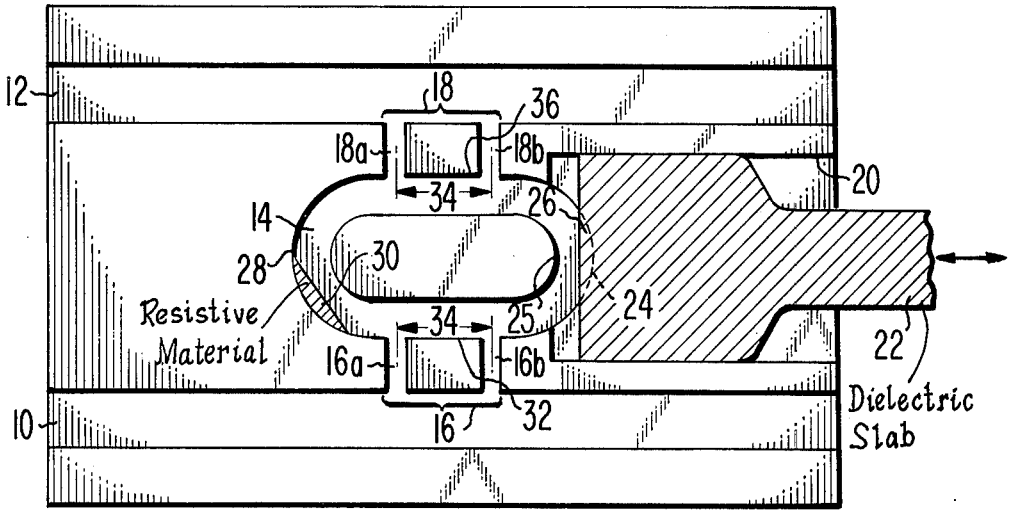
FIG. 2 is a sectional view of the preferred embodiment of the invention as seen along viewing line 2—2 of FIG. 1.

Referring to FIGS. 1 and 2, an input waveguide transmission line 10 and an output waveguide transmission line 12 are coupled to a ring resonator 14. In a preferred form of the invention, the transmission lines are rectangular waveguides within which an electromagnetic wave is propagated in its dominant $TE_{10}$ mode. However, other forms of transmission lines operating in other modes may be used.

Coupling of input line 10 to ring resonator 14 is achieved by directional coupler 16, having openings 16*a* and 16*b* and output line 12 is coupled to ring resonator 14 by directional coupler 18, having openings 18*a* and 18*b*. For a particular use of this invention in microwave systems, it is desired that a broadband signal be directionally routed between input and output transmission lines at a certain frequency band. Directionality is desirable since it routes the signal only toward devices with which it must communicate thereby conserving signal power. Thus, to obtain waves progressing in only one direction, directional coupling is used. In a basic form of directional coupling, two waveguides are connected by two or more openings appropriately spaced, the spacing being a function of the wavelength and permitting power to flow from the input waveguide into the output waveguide in one direction only. In a preferred form of this invention, the directional couplers 16 and 18 for coupling ring resonator 14 to the transmission lines are branched-guide couplers where the two openings of each are slots spaced at a distance 34 approximately one quarter wavelength of the guided wave at the midband frequency. The preference of the branched-guide couplers will be discussed subsequently. The determination of two openings is based upon the frequency band at which the filter will operate. The addition of more openings than two will increase the frequency bandwidth of the directional couplers. For this invention, the frequency bandwidth of the ring resonator is narrower than the frequency band of the couplers having two openings, therefore the two-hole coupler will provide a broad enough bandwidth for passage of the resonator frequency. It should be noted, however, that where a very broad frequency bandwidth of resonators is required, directional couplers having multiple openings appropriately spaced can be used to increase the coupler frequency band to accept the frequency band of the resonator.

The ring resonator 14 is a microwave device which is a waveguide formed to the shape of an annular ring, the length or circumference of the ring being any integral number of wavelengths of the guided wave. In general, a ring resonator when directionally coupled to a waveguide is capable of resonating with waves progressing in one direction whereas when nondirectionally coupled the resonance is with standing waves. The frequency response of a directionally coupled ring resonator at resonance is characteristic of a band-pass filter. The resonant frequency at which the length of the ring resonator is equal to an integral number of wavelengths is tuned by adjusting the electrical length of the guided wave in the ring. In the prior art, it was found that the resonant wavelength of a ring of guide of rectangular cross-section can be expressed by equation (1) above, viz.:

$$\lambda_{res} = \left[\frac{1}{\frac{N^2}{L^2} + \frac{1}{4A^2}}\right]^{1/2} \qquad (1)$$

where: $N$ is the integral number of wavelengths in the ring, $L$ is the mean circumference of the ring, and $A$ is the width of the guide, as previously described.

In a preferred embodiment of the invention as seen in FIG. 2, ring resonator 14 is formed to a substantially elongated annular ring having curved portions 24 and 28 and straight sections 32 and 36 respectively. It is preferable that the waveguide of ring resonator 14 be rectangular in cross-section although other cross-sections may be used. Slot 20 is formed in the radial portion 24 of resonator 14 in the plane where the electric field is maximum and the wall currents are approximately zero with a wave being propagated in its dominant mode. Slot 20 is formed to extend through the waveguide of resonator 14 to the inner radial portion 25. A flat dielectric slab 22 is formed to slide into slot 20 and thereby into resonator 14 the length of slab 20 being sufficient to extend from outer portion 24 to inner portion 25 and also of sufficient length to be manipulated for controlling its insertion. The insertion of dielectric slab 22 into ring resonator 14 introduces a capacitance into resonator 14 changing the length of the guided wave to thereby tune the resonant frequency of ring resonator 14. The frequency range over which the filter can be tuned is dependent upon the dielectric value of slab 22, the thickness of slab 22, the amount of insertion of the slab 22, the waveguide dimensions and the operational frequency desired. For example, it was found that with a ring resonator 14 of rectangular cross-section of 0.420 × 0.170 inches, a slab of Rexolite (dielectric constant of 2.54) 0.036 inch thick, the tuning range is from 22.194 GHz at zero penetration of slab 22 to 21.836 GHz at full penetration, or a total tuning range of 358 MHz.

In another embodiment of the invention, the introduction of a dielectric material to tune resonator 14 may be achieved by positioning a flat circular disc in a slot formed in the same preferred plane in resonator 14 as slot 20. By mounting the disc eccentrically about its center, rotation of the disc will vary the amount of the insertion and thereby tune resonator 14 to its resonant frequency.

An advantage which flat dielectric slab 22 or a flat dielectric disc has over the prior art is that of achieving a broadband match of coupled waveguide impedances. The prior art arrangements rely upon a gradual insertion or taper of the dielectric rod to achieve a broadband match which is also a function of the amount of insertion. In this preferred embodiment of the invention, the flat surface 26 of dielectric slab 22 or a flat disc combines with the curved-shape of the ring guide at radial portion 24 to establish a gradual introduction of the dielectric regardless of the amount of insertion, resulting in a broadband match of coupled waveguide impedances.

The substantially elongated ring resonator 14 is a preferable configuration when coupled to more desirable straight input waveguide 10 and straight output waveguide 12. It is preferable to utilize these straight waveguides instead of the U-shaped waveguides used in the prior art because they are easier to mount to data handling systems having limited space availability. Mounting is further simplified in a device tuned dielectrically since prior art arrangements requiring mechanical variation of the waveguide width for tuning also require compensation for the relative movement of the waveguide connection flanges due to the adjustment. Coupling of ring resonator 14 to the straight waveguides is accomplished at the straight sections 32 and 36 respectively. Branched-guide couplers are preferable in this invention since it is more advantageous in microwave data bus applications to maintain a sufficiently constant coupling value. Branched-guide couplers possess this characteristic even where the ring resonators are tunable. Because the branched lines between ring resonator 14 and input waveguide 10 and output waveguide 12 are of a finite length, it is geometrically simpler for manufacturing and more desirable for electrical performance to have each of the walls of the branched-guides the same length. This is achieved by connecting the straight waveguides to the straight sections 32 and 36 of ring resonator 14. A circular ring resonator may also be used to couple to the straight waveguides but some degradation of the desired performance will result due to the uneven length of each of the branched-guide walls.

The bandwidth of the directional filter is mainly a function of the quality factor, Q, of ring resonator 14. The quality factor, Q, is dependant upon the characteristics of the transmission line used for the ring, the number of wavelengths in the ring, and upon any additional attenuation in the ring. Additional attenuation decreases the value of Q, thereby increasing the bandwidth of the filter. The insertion of slab 22 or other low-loss dielectric material as used in the prior art provides little attenuation thereby having an insignificant effect upon the broadening of the bandwidth. By introducing into ring resonator 14, preferably at a location away from dielectric tuning slab 22 and directional couplers 16 and 18, a small vane of resistively metallized dielectric material 30, the wave is attenuated and the filter bandwidth is increased. Furthermore, the additional attenuation reduces the insertion loss along the input transmission line 10 caused by the tight coupling of ring resonator 14 to the waveguides. It should be noted that this means for providing a change in ring attenuation is not directly related to the means for tuning as is the prior art. This allows for not only independently maximizing the tuning range, but also for separately optimizing the filter bandwidth and the reduction of insertion loss.

Reduction of the input line insertion loss is an important feature of this invention for data bus and other applications because it retains an adequate portion of the signal in the input line in any coupled band to allow for additional coupling of other lines within the same frequency band. In most prior art devices, all the signal is coupled from the input to the output line which would leave other couplers in series starved for signal.

Figure 3:
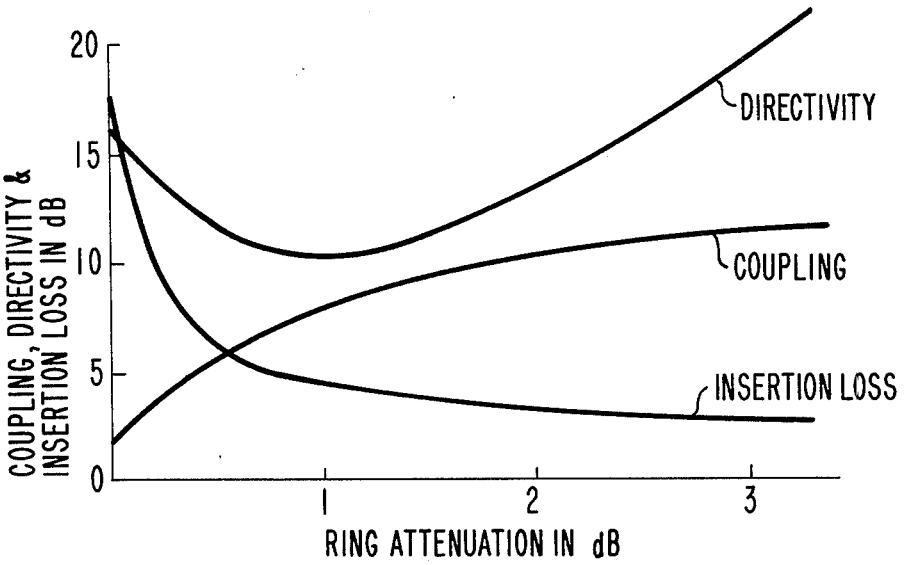
FIGS. 3 and 4 show curves summarizing measurements of various parameters made with a preferred embodiment of the invention.
Figure 4:
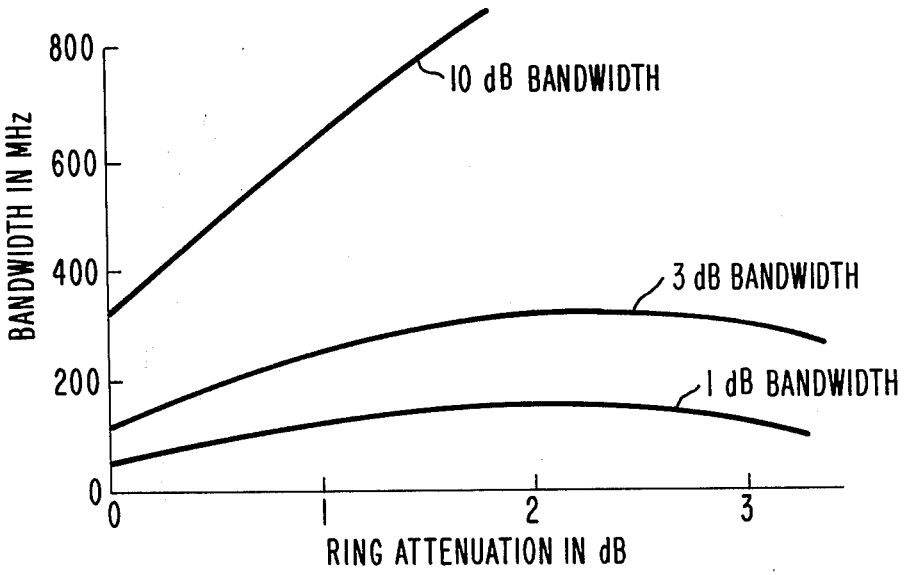

The measurements of a variable bandwidth tunable directional filter are summarized in FIGS. 3 and 4. For a device built without the additional attenuation, the tuning range as described previously is approximately 360 MHz centered about 22 GHz. This device uses a four wavelength ring with competing resonances outside the band at 18.9 and 25.4 GHz. The coupling of each of the directional coupler slot pairs is 9.6 dB, but when they are both coupled to an essentially lossless waveguide ring, the coupling through to the output line is only 2 dB down from the input level. In this case, the bandwidth is a moderate 120 MHz. Addition of the resistively metallized vane decreases the insertion loss as seen in FIG. 3 and as seen in FIG. 4, the 3 dB filter bandwidth as well as the 1 dB filter bandwidth optimize in the vicinity of 2 dB ring attenuation. With 2 dB ring attenuation, the filter bandwidth has increased substantially to 330 MHz, the insertion loss is reduced considerably to approximately 3 dB, while the coupling value has changed to 10.5 dB. These values prove useful for a directional filter in microwave data bus applications.

A variable bandwidth tunable directional filter such as the one described herein meets the requirements of data handling systems where multiple data bus lines are desirable for increased redundancy reliability and where such filters are capable of coupling to more than one data bus line simultaneously. Besides being directional, it is also preferable that the coupling of this filter be reciprocal to allow for development of transponder modules to combine the transmitter and sink functions. The adaptation of ring resonators in directional filters in waveguide transmission lines provides extensive bandwidths at high microwave frequencies enabling a single line to control two-way data transfer without recourse to wires and cables. This type of device is useful for data handling systems in aircraft, space vehicles, ship and building complexes where microwave data bus systems offer mature technology, abundance of bandwidth as well as the economy associated with a single bus.

What is claimed is:

1. A variable bandwidth tunable directional filter for controlling and processing signals in data handling systems, comprising:

an input waveguide transmission line;

an output waveguide transmission line;

a ring resonator directionally coupled to said input and said output waveguides, said ring resonator being a waveguide formed to an annular ring within which an electromagnetic wave is propagated, the circumference of said resonator being an integral number of wavelengths, the resonant frequency of said resonator being tunable by adjusting the electrical length of the guided wave in said resonator, said directionally coupled ring resonator being capable of resonating with waves progressing in one direction, the frequency response at said resonance being characteristic of a band-pass filter;

a directional coupler to couple said ring resonator to said input waveguide;

a directional coupler to couple said ring resonator to said output waveguide;

dielectric means introduced into said resonator for adjusting the guided wavelength to tune said ring resonator; and discrete attenuating means disposed within said ring resonator for attenuating said wave within said ring resonator for broadening the bandwidth of said directional filter and for decreasing the insertion loss of coupling said resonator to said waveguides to retain thereby a portion of said signal in said input transmission line to allow for additional coupling of other lines within said frequency bandwidth.

2. A variable bandwidth tunable directional filter according to claim 1, wherein said dielectric means for adjusting the guided wavelength comprises:

a slot formed in said resonator in the plane of the maximum electric field where the wall currents are approximately zero, said slot extending from the outer radial wall to the inner radial wall of said resonator waveguide; and a flat dielectric slab formed to slide into said slot in said resonator for introducing the dielectric material for changing the length of said guided wave to thereby tune said resonator, said slab combining with the bend of said resonator waveguide to provide a broadband match of the impedances of said coupled waveguides.

3. A variable bandwidth tunable directional filter according to claim 1, wherein said ring resonator is formed to a substantially elongated annular ring, said respective directional couplers to couple said elongated ring to said waveguides being positioned at each straight portion of said elongated resonator.

4. A variable bandwidth tunable directional filter according to claim 1, wherein said input and said output waveguides are straight rectangular waveguides with the electromagnetic wave being transmitted in its dominant $TE_{10}$ mode.

5. A variable bandwidth tunable directional filter according to claim 1, wherein said waveguide of said ring resonator is a rectangular waveguide.

6. A variable bandwidth tunable directional filter according to claim 1, wherein said respective directional couplers are branched-guide slot couplers having two branched lines for each coupler, said branched lines being spaced at a distance substantially equal to the length of one quarter wavelength of said electromagnetic wave at midband frequency.

7. A variable bandwidth tunable directional filter according to claim 1, wherein said means for attenuating the wave for broadening said filter bandwidth and reducing the insertion loss comprises a small vane of resistively metallized dielectric material introduced in said resonator at a selected position.

8. A variable bandwidth tunable directional filter according to claim 1, wherein said coupling of said resonator to said transmission lines is reciprocal to allow development of transponder modules that combine transmitter and receiver functions when coupled to transmission lines.

* * * * *